US005957705A

United States Patent [19]

David et al.

[11] Patent Number: 5,957,705

[45] Date of Patent: Sep. 28, 1999

[54] ELECTRICAL CONNECTOR INCLUDING MEANS FOR PREVENTING RELATIVE DISLOCATION OF THE CONDUCTIVE CONTACTS AND CIRCUIT BOARD CONNECTORS

[75] Inventors: James J. David; R. Douglas Sheaffer, both of Mechanicsburg, Pa.

[73] Assignee: Berg Technology, Inc., Reno, Nev.

[21] Appl. No.: 08/837,718

[22] Filed: Apr. 22, 1997

Related U.S. Application Data

[63] Continuation-in-part of application No. 08/367,081, Dec. 30, 1994.

[51] Int. Cl.[6] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 4,080,041 | 3/1978 | Hawkins, Jr. | 439/629 |
| 4,641,908 | 2/1987 | Steffinger | 439/599 |
| 4,655,518 | 4/1987 | Johnson et al. | 439/62 |
| 4,889,502 | 12/1989 | Althouse et al. | 439/607 |
| 5,104,326 | 4/1992 | Smith et al. | 439/95 |
| 5,133,670 | 7/1992 | Doi et al. | 439/79 |
| 5,201,664 | 4/1993 | Korsunsky et al. | 439/83 |
| 5,213,514 | 5/1993 | Arai | 439/79 |
| 5,263,867 | 11/1993 | Doi et al. | 439/62 |

OTHER PUBLICATIONS

TI Supply, Electronic Components Catalog, 1973 (3 pages).

Wing–Tech Enterprise Co. Ltd., Catalog, Nov., 1993 (3 pages).

*Primary Examiner*—Steven L. Stephan
*Assistant Examiner*—Barry M. L. Standig
*Attorney, Agent, or Firm*—Daniel J. Long; M. Richard Page

[57] ABSTRACT

An electrical connector having a front retaining shell and a rear housing with aligned longitudinal contact receiving passageways. A molded wafer is positioned between the housing and a circuit board. This wafer has apertures for receiving conductive contacts and the grounding legs on the front shell. A pair of rigid posts project upwardly from the wafer to engage the housing. Another pair of rigid posts project downwardly from the wafer to engage the circuit board. Relative dislocation of the conductive contacts, the grounding legs and the circuit board attachments is thus avoided so as to facilitate robotic placement of the connector.

4 Claims, 3 Drawing Sheets

ELECTRICAL CONNECTOR INCLUDING MEANS FOR PREVENTING RELATIVE DISLOCATION OF THE CONDUCTIVE CONTACTS AND CIRCUIT BOARD CONNECTORS

CROSS REFERENCE TO RELATED APPLICATION

This is a continuation-in-part of co-pending application Ser. No. 08/367,081 filed Dec. 30, 1994.

BACKGROUND OF THE INVENTION

1. Field of the Invention

The present invention relates to electrical connectors and more particularly to backplane connectors which are designed for connection to printed circuit boards.

2. Brief Description of Prior Developments

Connectors which are designed for use with printed wiring boards conventionally include a contact array which is received in the printed wiring board as well as at least one means for fixing the connector itself to the circuit board. The assembly of the connector to the circuit board by robotic means often requires that the contact array and separate means for fixing the connector to the circuit board be positioned from each other at distances which vary only within close tolerances. If this pin array and the connector fixing means become dislocated, it may be difficult or impossible to connect them to the circuit board by repeatable robotic motion. There is, therefore, a need for an electrical connector which includes means for preventing such relative dislocation.

SUMMARY OF THE INVENTION

The electrical connector of the present invention includes a front shell retaining means and a rear housing both of which have longitudinal contact receiving passageways. Conductive contacts extend through these passageways and then through apertures in a wafer. This wafer also has apertures which receive grounding legs extending rearwardly and downwardly from the front shell to engage the circuit board and a retention post which extends from the wafer to engage the circuit board. Relative dislocation of the conductive contacts, the front shield grounding legs and a retention post is, therefore, substantially avoided.

BRIEF DESCRIPTION OF THE DRAWINGS

The invention is further described with reference to the accompanying drawings in which.

DETAILED DESCRIPTION OF THE PREFERRED EMBODIMENT

Figure 1:
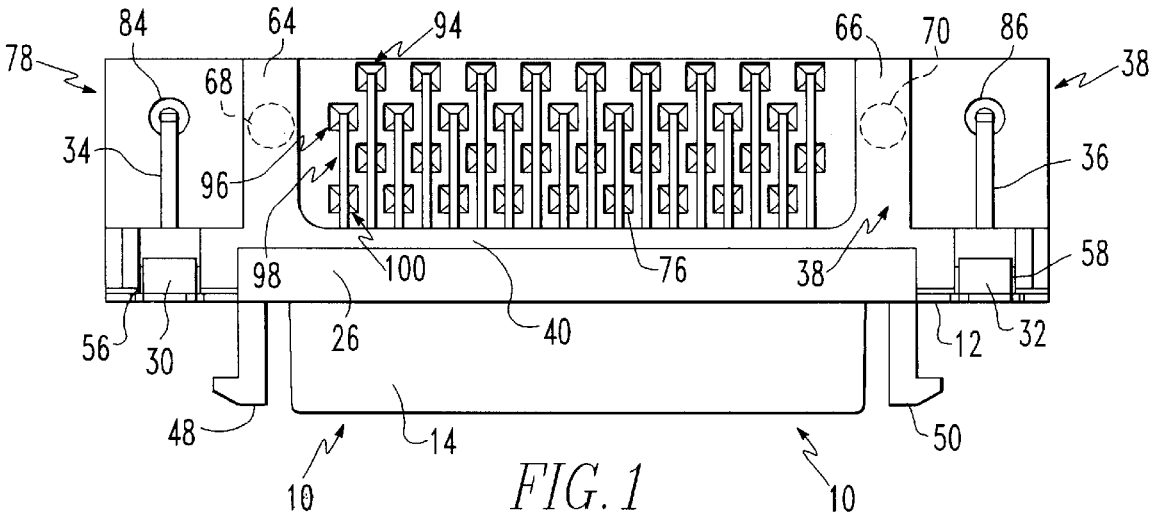
FIG. 1 is a top plan view of a preferred embodiment of the electrical connector of the present invention.
Figure 2:
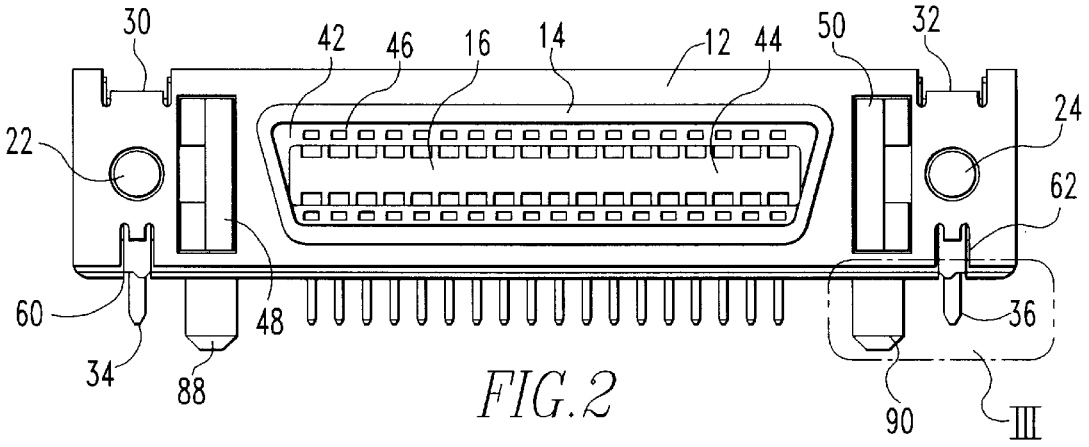
FIG. 2 is a front elevational view of the electrical connector shown in FIG. 1.
Figure 3:
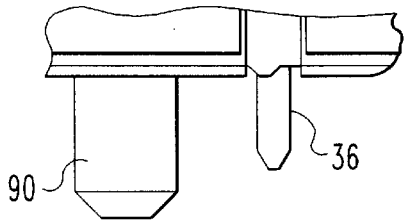
FIG. 3 is a detailed view of the area within circle III in FIG. 2.
Figure 4:
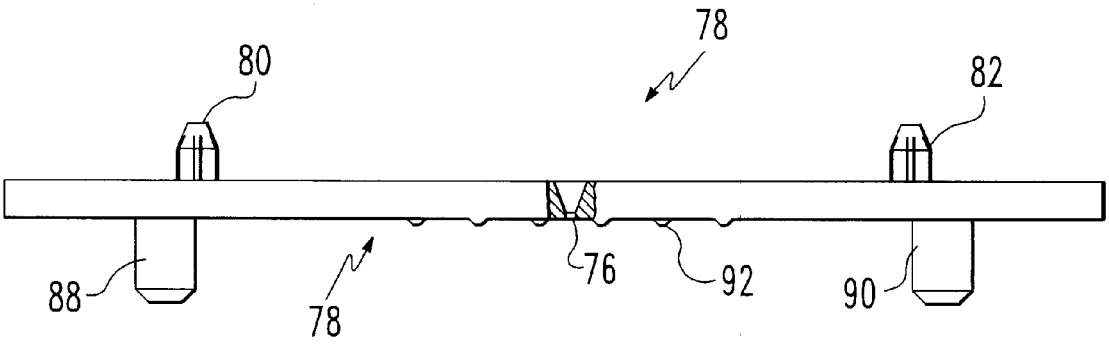
FIG. 4 is a partially cut away front elevational view of the wafer element in the connector shown in FIG. 2.
Figure 5:
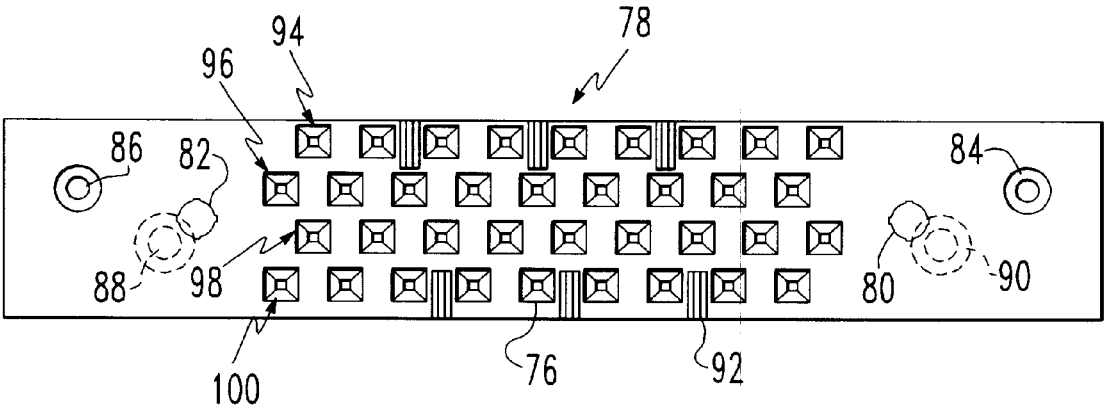
FIG. 5 is a top plan view of the wafer element shown in FIG. 4.
Figure 6:
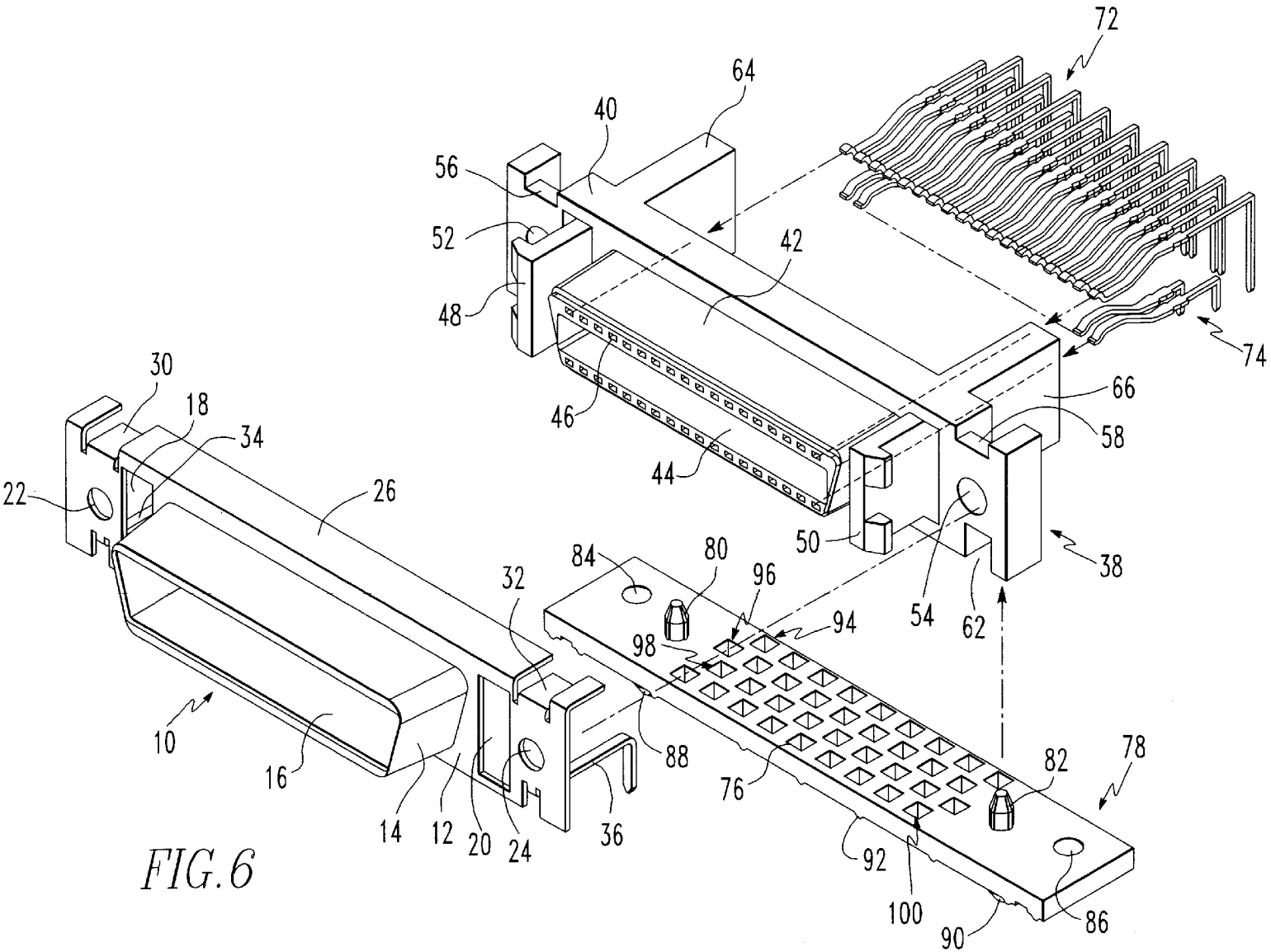
FIG. 6 is an exploded perspective view of the elements in the electrical connector shown in FIG. 1.

Referring to the drawings, the metallic front retaining shell is shown generally at numeral 10. This shell is made up of a front face 12 and a forward projecting flange 14 which surrounds a front contact receiving passageway 16. At the opposed lateral ends of the plate there are clip receiving apertures 18 and 20 and minor apertures 22 and 24 for receiving mounting hardware (not shown). The front retaining shell also includes a top rearwardly extending flange 26 and a bottom rearwardly extending flange (not shown). There are also top retention clips 30 and 32 provided for fixing this front retaining shell to the rear retaining housing as will be explained hereafter. As is also explained hereafter, circuit board grounding and connection legs 34 and 36 extend rearwardly and downwardly to connect the front retaining shell to the circuit board. As is conventional, those legs will be soldered to the circuit board after they are engaged. A rear retaining housing is shown generally at numeral 38. This housing includes a body section 40 from which there is a forward projecting flange 42 which has a central rear contact receiving passageway 44 which extends longitudinally from the front contact receiving passageway. In this forward projecting flange there are also windows as at 46 which may be used to allow the contacts to be inspected. Connection clips 48 and 50 extend forwardly from the body through apertures 18 and 20 in the front retaining shell to allow latching to a cable assembly (not shown). Apertures 52 and 54 are longitudinally aligned respectively with apertures 22 and 24 in the front retaining shell. The body also includes recesses 56 and 58 where the rear retaining element is engaged by the clips 30 and 32 on the front retaining shell. There are also recesses 60 and 62 for receiving, respectively, the ground connection legs 34 and 36 on the front retaining shell. Extending rearwardly from the body there are also longitudinal extensions 64 and 66 which have recesses respectively at 68 and 70 which are positioned on their bottom sides. An upper row of contacts generally shown at numeral 72 and a lower row of contacts generally shown at numeral 74 extend longitudinally through the front and rear contact receiving passageways. It will be understood that the lower row 74 is essentially identical to the upper 72 but that it is shown partially in phantom lines in FIG. 6. These contacts then extend perpendicularly downwardly to pass through contact receiving apertures as at 76 in a wafer shown generally at numeral 78. Preferably this wafer is molded from a high temperature plastic material. It will be seen that this wafer is transversely oriented with respect to the contacts. As is particularly shown in FIG. 4, the conductive contact receiving apertures have inwardly sloping walls which allow the conductive contacts to be initially positioned relative to each other for engagement with the wafer at a relatively large dimensional tolerances. After they have been engaged with the wafer, however, they will be positioned relative to each other and the circuit board attachment means and the grounding legs on the front retaining shell and rear housing at a desired close tolerance. After passing through the conductive pin receiving aperture, the conductive pins engage the circuit board. As is conventional, the conductive pins will then be soldered to the circuit board. This wafer extends transversely between and is connected to the rearward longitudinal extensions in the rear retaining element by means of rigid upward posts 80 and 82 which engage the bottom recesses 68 and 70 of the housing. This wafer also includes grounding leg receiving apertures 84 and 86 through which the grounding legs of the front retaining shell pass before they engage a circuit board. It will be understood that rigid extension posts 88 and 90 extend downwardly from the wafer to allow the entire assembly to be located and fixed by means of an interference fit to a circuit board (not shown). The wafer may also include standoffs as at 92 on its bottom side.

It will be appreciated that because of the structure of this electrical connector dislocation between the conductive contacts, the grounding legs on the front retaining shell and the retention posts on the wafer, will be substantially avoided when the connector is emplaced on a circuit board. It will, in particular, be appreciated that the relative positions of the rigid posts and grounding legs and conductive pins are defined by the position of the rigid posts and grounding leg and conductive pin receiving apertures on the single molded wafer. Close tolerances in these relative dimensions can thereby be easily and inexpensively achieved, and placement of the connector by repeatable robotic motion can be facilitated.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector for making a connection with a circuit board comprising a metallic front retaining means having a front contact receiving passageway having a pair of grounding legs for simultaneously fixing and grounding said front retaining means to the circuit board; a housing means having a contact receiving passageway and an engagement recess; a plurality of conductive contacts extending through said contact receiving passageway in the housing means and engaging said circuit board; and means for engaging said contacts comprising a safer being a single molded element and having first and second opposed sides a plurality of conductive contact receiving apertures, a pair of grounding leg apertures for engaging the pair of grounding legs of the metallic front retaining means, a first pair of rigid posts which project from the first side of the wafer to engage the circuit board and a second pair of rigid posts which extend from the second side of the wafer and are received in the engagement recesses in the housing means to fix the housing means to the wafer such that said second pair of rigid posts and said recesses in the housing are closely fitting to prevent dislocation between the wafer and the housing, and the conductive contacts each pass through a separate contact receiving aperture in the wafer and extend perpendicularly downwardly after they pass through the contact receiving passageway of the front retaining means and the pair of grounding legs extend from the front retaining means first rearwardly then perpendicularly to pass through said pair of apertures in the wafer, whereby the first pair of rigid posts extend beyond the pair of legs and conductive contacts said wafer prevents relative dislocation of said rigid posts, said pair of legs, and said conductive contacts.

2. The electrical connector of claim 1 wherein the second side of the wafer is the upper side and the first pair of rigid posts which project from said first side project upwardly.

3. The electrical connector of claim 2 wherein the housing has a lower side and the pair of recesses are on said lower side of the housing which are engaged by said second pair of posts which project from said side project upwardly.

4. The electrical connector of claim 3 wherein the first side of the wafer is the lower side and the first pair of the rigid posts which project from said first side project downwardly.

* * * * *